US005080270A

United States Patent [19]

Kai

[11] Patent Number: 5,080,270

[45] Date of Patent: Jan. 14, 1992

[54] CONTAINER FOR CONTAINING LONG AND FLEXIBLE PLASTIC OBJECT EQUIPPED WITH CUTTER

[75] Inventor: Hisao Kai, Chiba, Japan

[73] Assignee: Asahi Kasei Kogyo Kabushiki Kaisha, Osaka, Japan

[21] Appl. No.: 465,176

[22] PCT Filed: Jun. 22, 1989

[86] PCT No.: PCT/JP89/00621

§ 371 Date: Feb. 22, 1990

§ 102(e) Date: Feb. 22, 1990

[87] PCT Pub. No.: WO89/12581

PCT Pub. Date: Dec. 28, 1989

[30] Foreign Application Priority Data

Jun. 23, 1988 [JP] Japan ..... 63-153640

[51] Int. Cl.[5] ..... B65D 85/00; B65D 85/08

[52] U.S. Cl. ..... 225/52; 225/56; 225/80

[58] Field of Search ..... 225/77, 80, 39, 46, 225/56, 52, 106

[56] References Cited

U.S. PATENT DOCUMENTS 1,981,388 11/1934 Perry ..... 225/80

4,244,493 1/1981 Harrison ..... 221/46

FOREIGN PATENT DOCUMENTS 59-163158 9/1984 Japan .

59-221265 12/1984 Japan .

*Primary Examiner*—Douglas D. Watts

*Assistant Examiner*—John M. Husar

*Attorney, Agent, or Firm*—Armstrong, Nikaido, Marmelstein, Kubovcik & Murray

[57] ABSTRACT

A container (10, 10A) for a long object (50) has an opening (18) which is formed in the container wall (12) at a position adjacent to an open end edge (14) of the container and which allows the long object to be extracted therethrough. A first notch (22) is formed in the open end edge spaced from the opening (18) so as to extend in the direction of length of the container. The first notch is capable of receiving a portion of the long object extracted through the opening. A second notch (3) spaced apart from the first notch is formed in the open end edge of the container so as to extend in the direction of the length of the container. The second notch (30) is provided with a cutter (40) in the bottom thereof. The arrangement is such that the portion of the long object which has been extracted past the first notch is forced into the second notch so as to be cut by the cutter.

14 Claims, 3 Drawing Sheets

CONTAINER FOR CONTAINING LONG AND FLEXIBLE PLASTIC OBJECT EQUIPPED WITH CUTTER

TECHNICAL FIELD

This invention relates to a container for a long and flexible plastic object equipped with a cutter and, in particular, to a container for a roll of the long object in which a desired length of the long object is drawn out of the roll and cut off for use.

BACKGROUND ART

A typical example of the long and flexible plastic object may be a strip material formed of a plastic film. The long plastic film constituting such a strip material is folded up as needed in the width direction thereof and is used as a cord of the well-known type. When such a long plastic film is formed as a tube, a piece of it having an appropriate length can serve not only as a cord but also as a sack with one or both ends thereof being tied into knots. The applicant of the present application proposed a device adapted to contain a roll of such a long plastic film and to allow a desired length of the film to be extracted and cut off. The device is disclosed in Japanese Utility Model Unexamined Publication No. 59-175033. The above-mentioned device can contain not only a long plastic film formed as a tube or a flat film, but also a net-like plastic tube, a plastic rope, and so on. The device consists of a container, a side wall of which is equipped with an extraction opening through which the long object is drawn out to the exterior of the container. After being drawn out a desired length, the long object is drawn into a guide groove formed at a container end in correspondence with the opening and cut by a cutter provided in this guide groove. It may be easy for those skilled in the art to appreciate the great usefulness of this container equipped with a cutter.

However, the above device proposed in the Japanese Utility Model Unexamined Publication No. 59-175033 has a drawback: after cutting, the end section of the residual long object remains outside the container, protruding beyond the extraction opening a certain length. This protruding section is convenient in that the user can easily grasp it when using the long object. On the other hand, the end section protruding beyond the extraction opening to the exterior of the container spoils the outward appearance of the container when a plurality of such containers are supplied to the market as massproduced goods. When put in a showcase, such containers will create a rather poor impression on potential buyers. Also, when such containers are being used, they make a poor impression. This is an important problem since it is required that goods today create a pleasing impression as well as function satisfactorily. The appearance of the containers might be improved by packing them so that the protruding end sections of the long objects may be hidden. It should be noted, however, that such a procedure cannot but be reflected in the higher price of the container.

DISCLOSURE OF THE INVENTION

It is accordingly a principal object of this invention to provide a container equipped with a cutter in which the end section of the long object does not protrude to the exterior of the container after a piece thereof has been cut off and in which the end section of the long object is in a condition allowing it to be grasped with ease for the next use.

The above object can be achieved by providing a container for containing a long object equipped with a cutter, of the type adapted to contain a roll of the long and flexible plastic object and to allow the object to be drawn out a desired length and cut off, the above-mentioned container comprising: a cylindrical body with a relatively high rigidity which constitutes the container and which includes: an opening for extracting the long object which is formed in the wall of the container at a position near open end edge thereof and spaced apart from the above-mentioned end edge by a predetermined distance; a first notch which is formed in the wall of the container at a position near the above-mentioned end edge and spaced apart from the above-mentioned opening and which extends from the end edge in the length direction of the container, the above-mentioned first notch being adapted to receive the long object when it has been re-wound and having a bottom section and an inlet section whose width is smaller than that of the bottom section; a second notch formed in the wall of the container at a position on the periphery of the wall spaced apart from the first notch and extending from the above-mentioned end edge in the length direction of the container, the above-mentioned second notch being adapted to receive the re-wound long object; and a cutter provided on the bottom side of the second notch and adapted to cut the long object when it is forced into the second notch.

In another aspect of the present invention for attaining the above object, provided is a combination of a roll of a long and flexible plastic object and a container equipped with a cutter adapted to cut the long object when it is drawn out a desired length, the above-mentioned combination comprising: a roll of a long and flexible plastic object in the form of a cylindrical roll which allows the object to be successively drawn out through the middle section thereof; a container consisting of a cylindrical body with a relatively high rigidity which includes: an opening for extracting the long object which is formed in the wall of the container at a position near an open end edge thereof and spaced apart from the above-mentioned end edge by a predetermined distance; a first notch which is formed in the wall of the container at a position near the above-mentioned end edge and spaced apart from the above-mentioned opening and which extends from the end edge in the length direction of the container, the above-mentioned first notch being adapted to receive the long object when it has been re-wound and having a bottom section and an inlet section whose width is smaller than that of the bottom section; a second notch formed in the wall of the container at a position on the periphery of the wall spaced apart from the first notch and extending from the above-mentioned end edge in the length direction of the container, the above-mentioned second notch being adapted to receive the re-wound long object; and a cutter provided on the bottom side of the second notch and adapted to cut the long object when it is forced into the second notch.

The container may be a flat cylindrical body having an elliptical or oval cross section or an ordinary cylindrical body as long as its open end edge is large enough to allow the cut end section of the long object to be grasped by fingers In general, it is desirable that the cylindrical body be prepared by simply cutting a long cylindrical into pieces each having a predetermined length. A cylindrical body prepared by connecting two plates having a relatively high rigidity and elasticity to each other at their side sections by means of a flexible and strong material is advantageous in that the thickness of the container body is reduced as the side of the long object contained therein is reduced by use, thus becoming gradually less bulky.

The narrow inlet section of the first notch is preferably diverged from the notch bottom side toward the open end edge of the container so as to form a V-shaped section, thereby making it easier for the long object to be received in the first notch. By virtue of this configuration, the long object can be forced into the first notch with ease.

The inlet section of the second notch is preferably diverged from the notch bottom side toward the above-mentioned end edge so as to form a V-shaped section, thereby making it easier for the long object to be received therein. By virtue of this configuration, the operation of forcing the long object into the second notch and cutting it is facilitated. It is desirable that the edge line of the cutter be inclined with respect to the direction in which the long object is forced into the second notch. This arrangement enables the forced-in long object to be cut smoothly. Further, the cutter may be firmly secured to the inner surface of the container wall by means of a small plate, one side of which is equipped with an adhesive agent. This arrangement, which is quite simple, is highly recommended.

In order that the long object may be cut easily and quickly, it is desirable that the first notch and the second notch corresponding thereto be in such a positional relationship that they are spaced apart from each other on the periphery of the cylindrical container by a distance corresponding at least to a quarter of the periphery.

A typical example of the long object to be used in this invention is a long tube formed of a plastic film. The plastic film is drawn to narrow it in the width direction into a thin cord (i.e., narrowed around the center in the width direction of the film so as to make it thinner) in accordance with the width thereof, or folded in two or four or in a zigzag-like manner, and wound into a cylindrical roll before being contained in the container. The winding of the long object is effected in such a manner that the long object can be successively drawn out through the central section thereof, with no core being provided in the central section. The film, narrowed or folded up into a thin cord, is generally wound by a winding method called traverse winding, i.e., wound spirally around the roll core. When the film reaches a winding end, it is turned back in the axial direction, thus continuing the winding. If the plastic film has an appropriate width, it may be wound in the normal manner (i.e., simply, not spirally). The advantage of thus not drawing the film to narrow it in the width direction into a thin cord is that the number of wrinkles made when the ends of a piece of the film are tied into knots to use it as a sack is relatively small. It is desirable that the plastic film be wound closely and tightly. Tight winding is advantageous in that the roll obtained is not bulky and the roll can be prevented from being detached from the container by firmly attaching part of the outer periphery thereof directly to the inner surface of the wall of the container by means of a double-coated adhesive tape or the like. It might be possible to contain the roll in a separate sack and contain this sack in the container along with the roll. However, this is not necessary if the film is wound tightly as stated above.

The plastic material for the film may, for example, be polyethylene, polypropylene, nylon, polyester, etc.

The operation of cutting the long object is performed in accordance with the following procedures (1) to (5):

(1) The end section of the long object is drawn out of the container through the opening;

(2) Drawing out the long object is continued until it is visually ascertained that roughly a desired length of the long object has been drawn out;

(3) The portion of the long object thus drawn out is pulled through the opening along the outer wall of the container is such a manner that its end section is directed straight to the inlet position of the first notch;

(4) The long object is forced into the first notch; and (5) The end section of the long object is bent at the portion which has been forced into the first notch and is brought to the inlet position of the second notch by pulling it, where it is forced into the second notch so as to cut it.

While in the procedure (4) the long object is forced into the first notch before it is cut, it is not necessary to perform this forcing at this stage. The portion described above as being forced into the first notch may be forced into the same after the cutting of the long object. In any case, the free end portion of the long object after the cutting of the long object is situated in the container and directed to the second notch, without protruding outwardly at right angles to the container wall.

Other features of the present invention will be made apparent by reference to the following description of the embodiments together with to attached drawings.

BEST MODE FOR CARRYING OUT THE INVENTION

Figure 1:
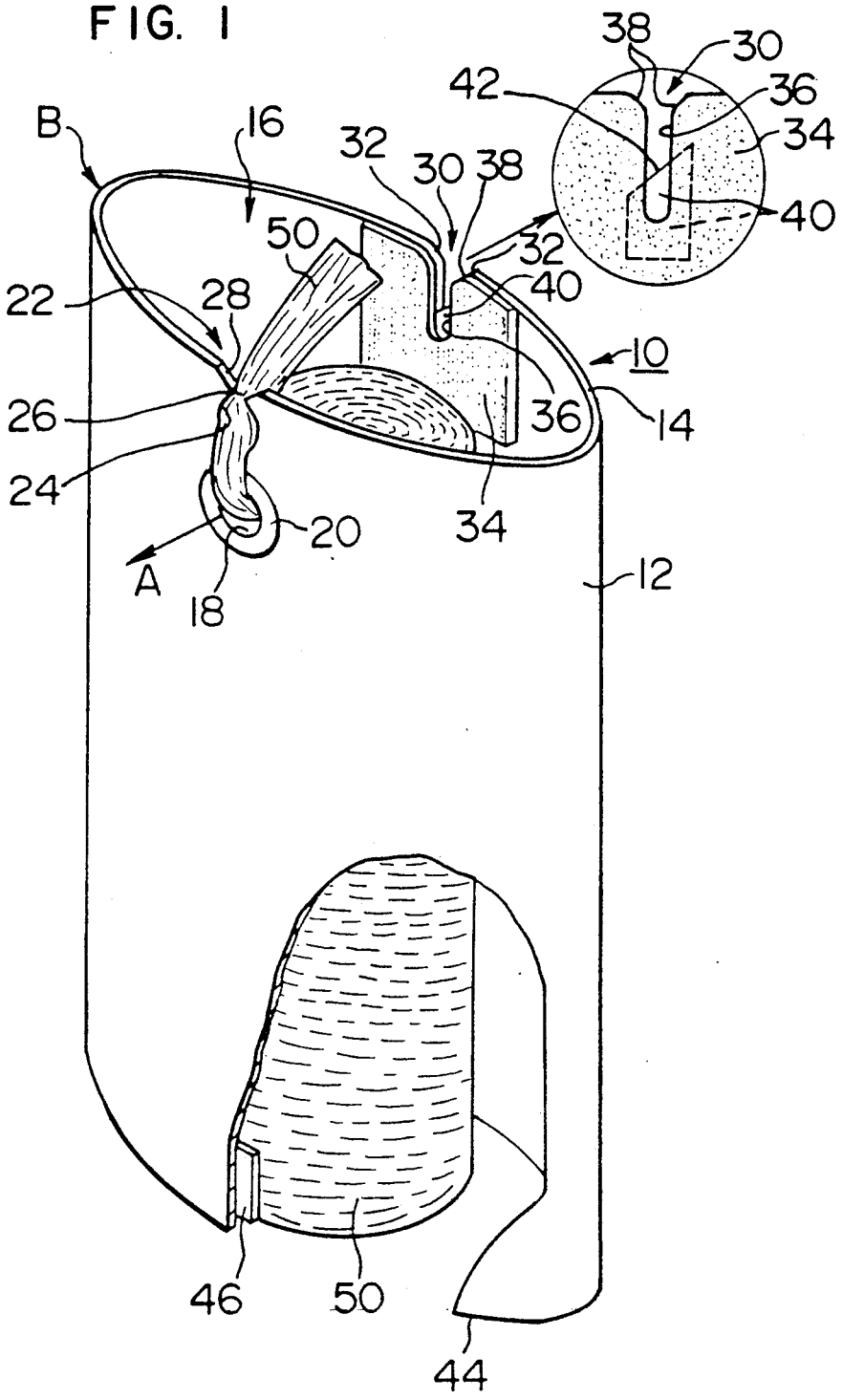
FIG. 1 is a partially cutaway perspective view of the essential parts of a container for a long and flexible plastic object equipped with a cutter in accordance with an embodiment of this invention, with a long object contained therein.

FIG. 1 shows, with substantial faithfulness, the overall configuration of a container 10 for containing a long object. The container includes a cylindrical container wall 12 which has an elliptical or oval cross section, an upper end edge 14, and an upper opening 16, the contour of the upper end edge 14 or the configuration of the upper opening 16 schematically indicating the cross section of the container wall. It is obvious that the shorter diameter of the cylindrical container wall 12 determines the outer diameter of a long object 50 which is to be contained in the container 10 and which will be described below. However, it will be easily understood that a flexible long object which can be easily deformed by pressing it in the radial direction will change its shape as the flat cylindrical container 10 changes its shape.

The container 10 is made of polypropylene and prepared by extrusion. The wall 12 of the container 10 has a small opening 18 for extracting the long object which is formed at a position near the upper end edge 14 and somewhat spaced apart from this upper end edge 14. The peripheral edge of the small opening 18 is equipped with a C-shaped metal rim 20 so that the long object can be drawn out smoothly. The inner diameter of the small opening 18, hemmed with the metal rim 20, should be large enough to allow the long object, narrowed into a cord, to pass freely therethrough.

Further, a first notch 22 is formed substantially in the middle of a wide side surface of the container wall 12 at a position directly above the small opening 18, the first notch 22 extending from the upper end edge 14 in the length direction of the container 10 (i.e., downwards). The first notch 22 is defined by a circular section 24 situated near the small opening 18 and a V-shaped inlet section connected to the upper end edge 14 and composed of two inclined sides 28 (The latter section may, more preferably, be equipped with an arc-like configuration with an appropriate curvature). The area where the above two sections ar connected to each other is formed as a narrow section 26 whose width is smaller than those of the other two sections. The width of the narrow section 26 is such that the long object can be passed from the V-shaped inlet section to the circular section 24 or reversely. It should be noted that the V-shaped inlet section ensures the long object being forced into the first notch 22 quickly and easily.

A second notch 30 is formed in the container wall 12 at a position facing the first notch 22, the second notch 30 extending from the upper end edge 14 in the length direction of the container 10 (i.e., downwards). The first and second notches 22 and 30 should be spaced apart from each other on the container circumference by a distance corresponding at least to a quarter of the periphery of the container. The second notch 30 is formed as a U-shaped notch which is long and narrow. Its inlet section, i.e., its upper end, is, like the first notch 22, formed as a V-shaped section connected to the upper end edge 14 and includes two inclined sides 32. The second notch 30 has a metal cutter 40 at a position on the bottom side thereof. This cutter 40 is attached to the inner surface of the container wall 12 in such a manner as to look out on the second notch 30 from the inside of the container and is firmly secured to the container wall 12 by means of a small plate 34 which is equipped with adhesive agent. The small plate 34 has a notch 36 which can be brought into registration with the second notch 30 and which is equipped with a pair of inclined sides 38, 38, and is secured to the container wall 12 in such a manner that this notch 36 is in registration with the second notch 30 (see the portion in FIG. 1 enclosed with a small circle). The fixed cutter 40 is arranged in such a manner that, supposing the upper end edge 14 is in a horizontal plane, its edge line 42 is inclined with respect to this horizontal plane. This inclination of the edge line 42 will enable the long object to be cut smoothly as it is forced into the second notch 30.

Figure 2:
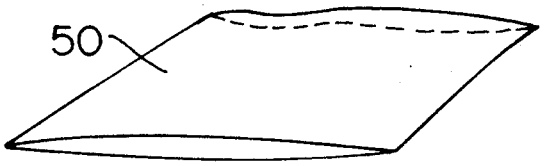
FIG. 2 is a perspective view of the essential parts of a continuous tube material formed of a plastic film as the long object, showing the cut-end configuration of the tube.
Figure 4:
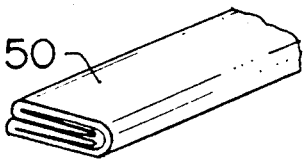
FIG. 4 is a perspective view of the essential parts of this tube material, showing the tube as narrowed in the width direction into a thin cord.
Figure 7:
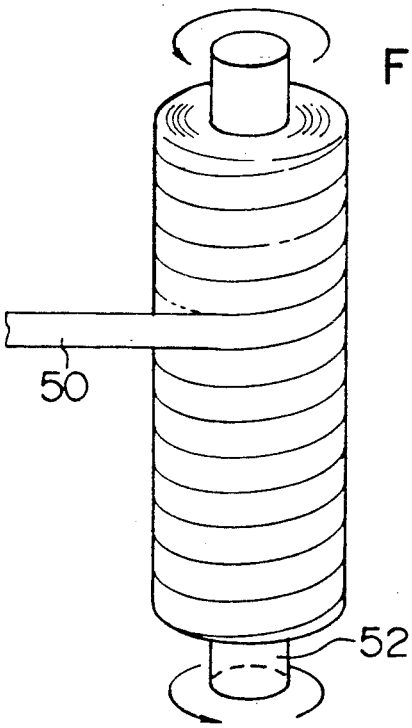
FIG. 7 is a schematic perspective view of a continuous tube material formed of a plastic film as the long object, showing the tube material as wound up by the traverse winding method.

As shown in FIG. 1, the long object 50, wound into a cylindrical roll, is contained in the container 10. The long object 50 is secured to the inner surface of the container wall 12 at a position near the lower end edge 44 of the container wall 12 by means of a gluing (or adhesive) agent 46. This securing relationship Prevents the long object 50 from being detached from the container 10 or making a relative rotation with respect to the container 10. Further, instead of simply using the gluing agent 46, a double-coated sticky tape may be employed. The long object 50 consists of a continuous tube material (with a periphery of about 40 cm) which is made of a biaxially-oriented polypropylene film. The long object 50 has a cut-end configuration as shown in FIG. 2 and is narrowed in the width direction, as shown in FIG. 4, before being spirally wound. FIG. 7 shows the way in which the long object 50 is traversely wound into a spiral cylindrical roll. Reference numeral 52 in the drawing indicates a winding core which is rotatably driven. The long object 50 in the form of a cylindrical roll is used with this winding core removed therefrom. The long object 50 in the form of a cylindrical roll can be easily deformed into a configuration having an elliptical cross section by pressing it in the radial direction. Accordingly, it can be brought into concordance with the configuration of the cross section of the container 10 having a flat cylindrical configuration.

The end section of the long object 50, contained in the container 10, can be drawn out through the middle section of the roll. After being brought to the exterior of the container through the small opening 18, it is put in the V-shaped inlet section of the first notch 22 and is then forced into the circular section 24. This condition is shown in FIG. 1.

When using the long object 50, its end section, which is in the position shown in FIG. 1, is grasped and drawn out a desired length. Then, the section of the long object 50 thus drawn out is tensed in such a manner that it is directed straight from the circular section 24 to the second notch 30, and, in this condition, the drawn-out section of the long object 50 is forced into the second notch 30. The section of the long object 50 thus forced into the second notch 30 is, as stated above, smoothly cut by the cutter 40. It is preferable, when drawing out the long object 50 a desired length, to detach the end section of the long object 50 from the first notch 22 and pull it in the direction indicated by arrow "A" since this procedure helps to avoid to some degree the frictions resistance between the long object 50 and the container wall 12. In that case, the above-described cutting operation can be performed while simply holding the end section of the long object 50 against the V-shaped inlet section of the first notch 22. After the cutting of the long object 50, the free end section of the long object is, as shown in FIG. 1, set in the first notch 22, thereby causing the free end section to be set in the upper end opening 16 of the container 10 and extend upwardly toward the second notch 30. This condition is superior in appearance to the case where the free end section is allowed to protrude beyond the opening 18 straight in the direction indicated by arrow A. Yet, this condition obviously enables the end section of the long object 50 to be grasped easily for the next use of the same. Further, the section of the long object 50 positioned in the circular section 24 of the first notch 22 is retained in a stable manner in the first notch 22 by virtue of the narrow section 26.

The facility with which the end section of the long object 50 is brought to the second notch 30 while keeping it engaged with the first notch 22 so as to be stretched over the upper end opening 16 of the container 10 is guaranteed by the fact that the distance between the first and second notches 22 and 30 corresponds at least to a quarter of the periphery of the container 10. Supposing the above-mentioned distance is a quarter of the periphery of the container, the second notch 30 is at the position indicated by arrow "B" when the first notch 22 is at the position shown in FIG. 1.

Figure 3:
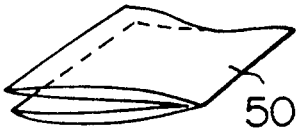
FIG. 3 is a perspective view of the essential parts of this tube material, showing the tube as folded in two in the width direction thereof.

The long object 50, which has the configuration shown in FIG. 2, may be folded in two in the width direction, as shown in FIG. 3, or further folded at the center in the width direction (folded in four), or further folded inwardly at its ends in the width direction from the condition shown in FIG. 3 (folded in four), and wound up simply, not spirally. In that case, the width of the long object after folding is equal to the length of the roll.

Figure 5:
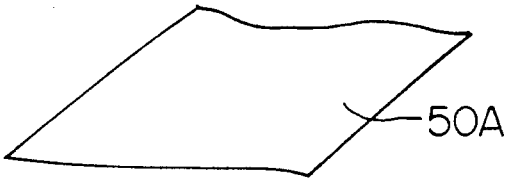
FIG. 5 is a view similar to FIG. 2, showing a long object formed of a plastic film which has a simple flat-short-like configuration.
Figure 6:
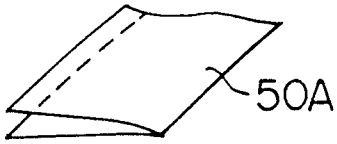
FIG. 6 is a view similar to FIG. 3, showing the long object of FIG. 5 as folded in two in the width direction thereof.

FIG. 5 shows a long object 50A which is not a tube material but a simple polypropylene film. FIG. 6 shows this long object folded in two.

Figure 8:
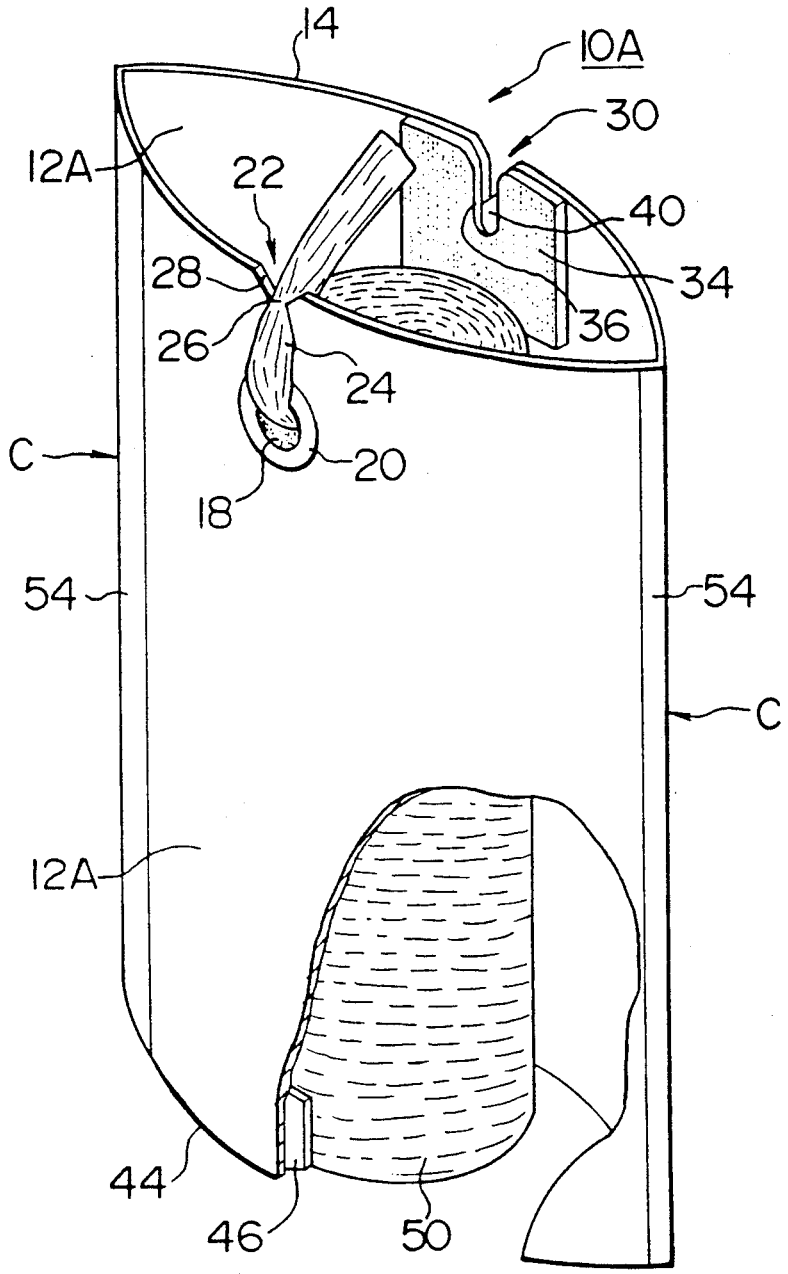
FIG. 8 is a partially cutaway perspective view of the essential parts of a container for a long and flexible plastic object equipped with a cutter in accordance with another embodiment of this invention, with a long object lodged therein.

FIG. 8 shows a container 10A constituting a modification of the container 10. This container 10A differs from the container 10 in the configuration of the cross section of a container wall 12A and the preparing method thereof. The container 10A is a cylindrical body formed by connecting two square plates, which have a relatively high rigidity and, at the same time, a high elasticity, to each other at the ridges indicated by arrow "C" by means of an adhesive tape 54 which has flexibility and a sufficient tensile strength. The shorter diameter of this container 10A is reduced and the longer diameter thereof augmented as the roll of the long object 50 contained therein is consumed. By virtue of the configuration of its cross section, this container 10A can be suitably fitted into a garment pocket of a user. Furthermore, as stated above, the thickness of the container 10A decreases as the long object 50 is consumed, which means pocket swelling will also be reduced.

INDUSTRIAL APPLICABILITY

The container for a long and flexible plastic object equipped with a cutter is a device adapted to contain and keep the long object in a compact form, allowing it to be drawn out a desired length and cut off. The long object can be used as a cord, a sack, etc. having an arbitrary length, so that the container offers great utility as a device which can be used for homes, offices, shops, or which can be carried about in a user's pocket.

What is claimed is:

1. A container equipped with a cutter, for containing a roll of a long and flexible plastic tube and allowing a desired length of the tube to be drawn out and cutt off, said container comprising:

a cylindrical container body with a relatively high rigidity having an opening for extracting the long tube and which is formed in a wall of the container body at a position near an open and edge thereof and spaced apart from said end edge by a predetermined distance;

a first notch which is formed in the wall of the container body at a position near said and edge and spaced apart from said opening and which extends from the end edge in the length direction of the container body, said first notch being adapted to receive the long tube when it has been drawn out and having a bottom section and an inlet section, the width of the inlet section being smaller than that of the bottom section wherein the inlet section retains the tube within the bottom section in a stable manner;

a second notch formed in the wall of the container body at a position on the periphery of the container body spaced apart from the first notch and extending from said end edge in the length direction of the container body, said second notch being adapted to receive the drawn out long tube; and a cutter provided on bottom side of the second notch and adapted to cut the long tube when it is forced into the second notch.

2. A container as claimed in claim 1, wherein the inlet section with a small width of said first notch is preferably diverged from the notch bottom side toward the open end edge of the container body so as to form a V-shaped section, thereby making it easier for the long tube to be received in the notch.

3. A container as claimed in claim 1, wherein the inlet section of said second notch is preferably diverged from the notch bottom side toward the open end edge of the container body so as to form a V-shaped section, thereby making it easier for the long tube to be received in the notch.

4. A container as claimed in claim 1, 2 or 3, wherein said first notch and said second notch corresponding thereto are in such a positional relationship that they are spaced apart from each other on the periphery of the cylindrical container body by a distance corresponding at least to a quarter of the periphery.

5. A container as claimed in claim 1, wherein said container body consists of a flat cylindrical body having an elliptical or oval cross section.

6. A container as claimed in claim 1, wherein the edge line of said cutter is inclined with respect to the direction in which the long tube is forced into the second notch.

7. A container as claimed in claim 1 or 6, wherein said cutter is firmly secured to the inner surface of the wall of the container body by means of a small plate one side of which is equipped with an adhesive agent.

8. A container as claimed in claim 1, wherein said long tube is formed of a plastic film.

9. A combination of a roll of a long and flexible plastic tube and a container equipped with a cutter adapted to cut the long tube when it is drawn out a desired length, said combination comprising:

a roll of a long and flexible plastic tube in the form of a cylindrical body which allows the object to be successively drawn out through the middle section thereof;

a container body comprising of a cylindrical body with a relatively high rigidity having an opening for extracting the long tube and which is formed in a wall of the container at a position near an open and edge thereof and spaced apart from said end edge by a predetermined distance;

a first notch which is formed in the wall of the container body at a position near said end edge and spaced apart from said opening and which extends from the end edge in the length direction of the container body, said first notch being adapted to receive the long tube when it has been drawn out and having a bottom section and an inlet section; the width of the inlet section being smaller than that of the bottom section;

a second notch formed in the wall of the container body at a position on the periphery of the wall spaced apart from the first notch and extending from said end edge in the length direction of the container body, said second notch being adapted to receive the drawn out long tube; and a cutter provided on a bottom side of the second notch and adapted to cut the long tube when it is formed into the second notch.

10. A combination as claimed in claim 9, wherein the long tube drawn out through the middle section of said roll is first brought to the exterior of the container body through said opening for extracting the long tube and then drawn into the container body through said first notch.

11. A combination as claimed in claim 9, wherein part of the outer periphery of said long tube wound up into a cylindrical roll is attached to the inner surface of the wall of the container by means of a gluing or adhesive agent.

12. A combination as claimed in claim 9, wherein said long tube is formed of a plastic film.

13. A combination as claimed in claim 12, wherein said long tube wound up into a cylindrical roll is a plastic made of any one of the following materials: polyethylene, polypropylene, nylon, and polyester.

14. A combination as claimed in claim 12, wherein said long tube is folded up in the width direction thereof before being wound up into a cylindrical roll.

* * * * *